US006228489B1

(12) United States Patent
Fagge et al.

(10) Patent No.: US 6,228,489 B1
(45) Date of Patent: May 8, 2001

(54) FIBRILLATED ACRYLIC FIBER

(75) Inventors: John Fagge, Grimsby (GB); Ulrich Holzinger, Kelheim (DE)

(73) Assignee: Acordis UK Limited, Derby (GB)

( * ) Notice: Subject to any disclaimer, the term of this patent is extended or adjusted under 35 U.S.C. 154(b) by 0 days.

(21) Appl. No.: 09/381,419

(22) PCT Filed: Mar. 20, 1998

(86) PCT No.: PCT/GB98/00856

§ 371 Date: Sep. 20, 1999

§ 102(e) Date: Sep. 20, 1999

(87) PCT Pub. No.: WO98/42899

PCT Pub. Date: Oct. 1, 1998

(30) Foreign Application Priority Data

Mar. 21, 1997 (GB) ..... 9705920

(51) Int. Cl.[7] ..... D01F 6/00; D01F 6/18

(52) U.S. Cl. ..... 428/364; 428/394; 428/359

(58) Field of Search ..... 428/364, 394

(56) References Cited

U.S. PATENT DOCUMENTS 3,867,499 * 2/1975 Morgan ..... 264/210 F
4,789,509 * 12/1988 Iked et al. ..... 204/29.2
5,508,109 * 4/1996 Patil et al. ..... 428/364

* cited by examiner

*Primary Examiner*—N. Edwards
(74) *Attorney, Agent, or Firm*—Howson & Howson

(57) ABSTRACT

Fibrillated acrylic fibers which are suitable for oxidation in the form of staple fibers are formed as copolymers of acrylonitrile and an unsaturated carboxylic acid such as itaconic acid or methacrylic acid. A further monomer may also be included, such as methacrylate, methylmethacrylate or vinyl acetate. Fibers having a Canadian Freeness valve of 350–500, and a decitex value of 1.2 to 1.7 may be produced.

10 Claims, 2 Drawing Sheets

B1, 200X FIBRILS ATTACHED

FIBRILLATED ACRYLIC FIBER

This invention relates to fibrillated acrylic fibers, and in particular to fibers which are oxidizable to form oxidized acrylic fibers.

Polyacrylonitrile fibers have been converted commercially to carbon fibers for a number of years. A known process is described in U.S. Pat. No. 3,533,743, in which the acrylonitrile fiber is oxidized prior to carbonization and graphitization. The acrylonitrile fiber is typically placed under tension during the oxidation phase of the process so that essentially carbon fiber is made from continuous filament acrylonitrile fiber. Continuous filament carbon fiber is used as reinforcement in composite materials for the manufacture of high-strength/low-weight composites, used for example in fishing rods, tennis racquets and racing car body parts. Where the carbon fibers are used in short lengths for discontinuous fiber reinforcement, these are obtained by chopping the continuous filament into short lengths.

Fibrillated acrylic fibers are disclosed, for example, in EP-A-0,265,762.

The present invention provides fibrillated acrylic fibers which are suitable for oxidation in the form of staple fibers, and which are copolymers of acrylonitrile and an unsaturated carboxylic acid.

Such fibers are particularly suitable for oxidation to form fibrillated oxidized acrylic fibers. Preferably the fibers are copolymers of acrylonitrile and itaconic acid or methacrylic acid. Preferably the fiber contains 0.5–2% itaconic acid groups. The copolymer fiber may comprise a further monomer such as methylacrylate, methylmethacrylate or vinylacetate, or any combination thereof. Typically the copolymer contains 3–8% of the further monomer. The staple fibers have a length of about 4–8 mm and are fibrillated to a Canadian Freeness value of less than 700 and more typically 350–500.

The fiber has a decitex value of between 0.6 and 6.0 decitex, preferably about 1.2–1.7 decitex.

Also according to the invention there is provided a method of manufacture of oxidizable acrylic fiber in which a staple acrylic fiber is made by copolymerization of acrylonitrile and an unsaturated carboxylic acid, and is fibrillated in the gel state prior to drying.

The staple fiber is cut to a length in the range of 4–8 mm, preferably 6 mm.

Further monomers such as methyl acrylate, methyl methacrylate or vinyl acetate may be added to the copolymerization.

Preferably the acrylic fiber comprises 0.5–2% itaconic acid, 3–8% methyl acrylate, and 90–96.5% of acrylonitrile.

The itaconic acid or methacrylic acid may be added in the form of free acid or as a sodium or amine salt.

Figure 1:
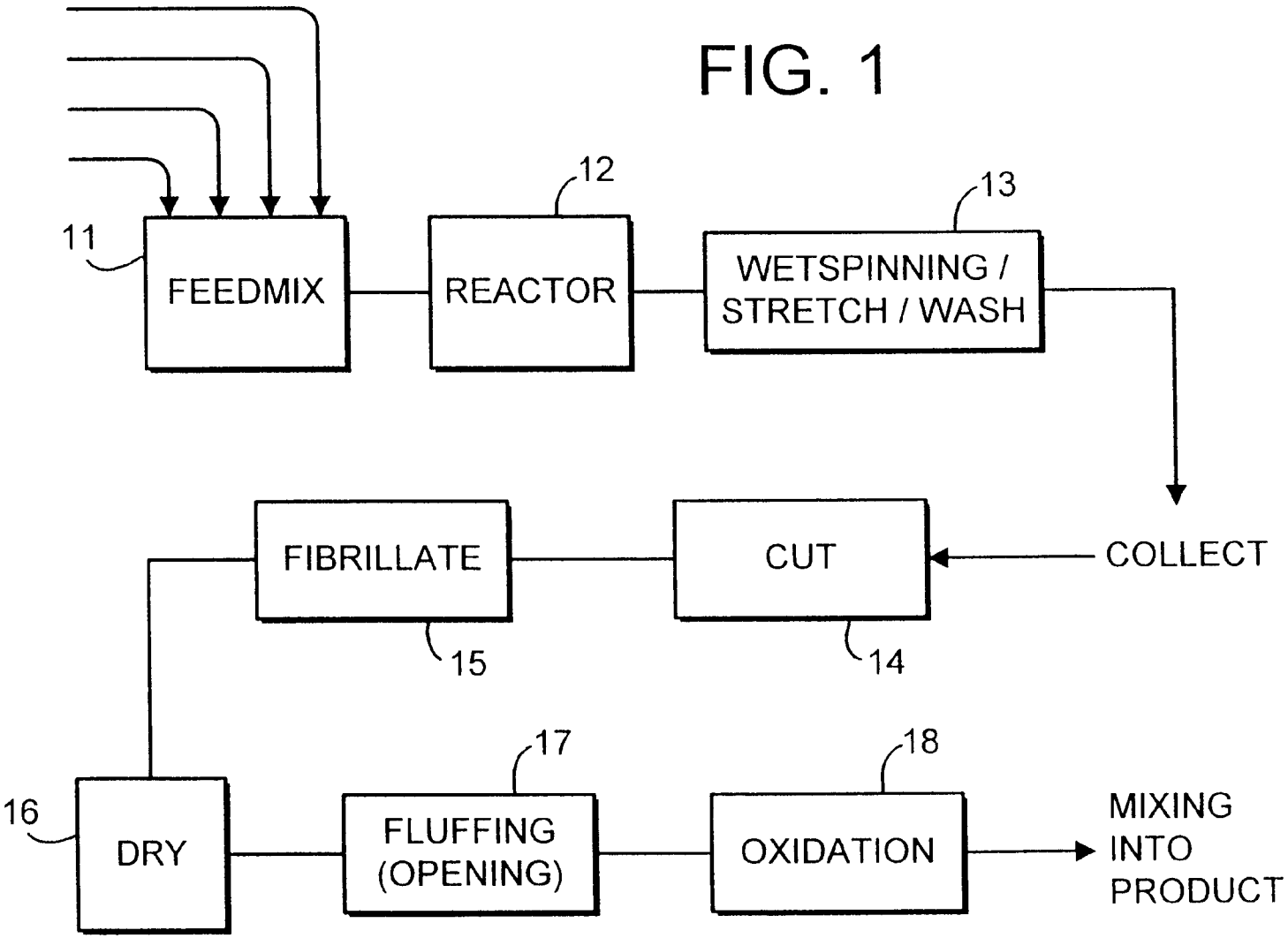
Figure 2:
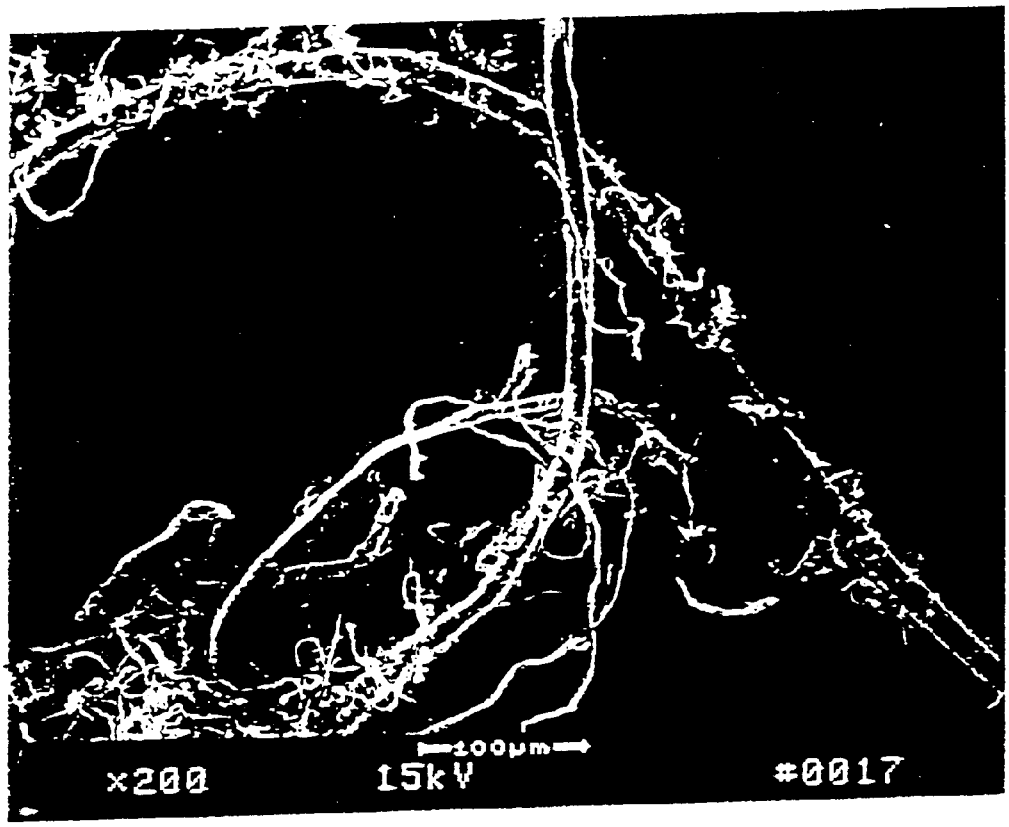

The invention will hereinafter be described by way of example and with reference to the accompanying drawings in which:

FIG. 1 is a schematic drawing of various stages in the production of fibrillated polyacrylonitrile fibers, and FIG. 2 is a photograph of the fibrillated staple fibers made according to the present invention in Example B after 240 minutes refining.

A reaction mixture containing 93.5% acrylonitrile, 5% methyl acrylate and 1.5% itaconic acid (% by weight) is mixed in a feed mix vessel (11) with sodium thiocyanate, accelerators and initiators and is then polymerized in solution in a reactor (12). The polymerized polyacrylonitrile copolymer is then wet spun at a spinning cell (13) into a dilute solution of sodium thiocyanate having a specific gravity of 1.052, stretched, washed and cut (14) into staple fiber having a length in the range 4–12 mm, preferably 6 mm–8 mm.

The polyacrylonitrile is spun and drawn to produce fiber having a decitex value in the range 0.6–6.0 decitex, preferably about 1.2–1.7 decitex.

The staple fiber is then mechanically fibrillated in its gel state (never-dried) as a dispersion in the range 0.5–3% fibers by weight in water. The fiber is processed in a suitable fibrillating apparatus (15) such as a disc refiner e.g. a Sprout-Waldron type 105 available from Sprout-Waldron & Co., Muncy, Pa., USA. The fibrillating apparatus basically comprises a pair of disc-like plates about 30 cm in diameter and spaced apart by a variable distance of between 0.2 and 3.75 mm. One plate is fixed and the other plate rotates at a speed of about 3,000 revolutions per minute.

The dispersion is continuously recycled through the apparatus for a number of cycles to increase fibrillation. In the examples which follow, the refining time is given as a total refining time.

The through-put through the disc refiner can be varied from 50 liters per minute up to 900 liters per minute.

The fibrillated loose staple fiber is then passed into an oven (16) for drying, and is then suitable for oxidation. The fiber is opened out (17) and then passed into an oven for oxidation. Oxidation may take place with the opened fibers spread thinly on trays. The polyacrylonitrile (PAN) fiber may be held at 225° C. for two hours to produce a fibrillated oxidised PAN fiber containing about 8% of added oxygen (by weight).

Such fibers may be used as reinforcing fillers in other compounds.

The degree of staple fiber fibrillation varied with the processing time as detailed below in the fibrillation tests.

Fibrillation Test 1

The fibrillation obtained over different refining time periods is expressed as water retention and imbibition value measured in accordance with DIN 53814. The results are given in Table 1 and Table 2 below. The degree of fibrillation was determined for the following examples in which 6 mm staple fiber was dispersed in 600 liters of water which was continuously passed through a disc refiner at a throughput of 500 liters per minute, with the two plates set 1.0 mm apart.

TABLE 1

Water Imbibition

| Refining time | Water Imbibition % | | |
|---|---|---|---|
| (mins) | Example A | Example B | Example C |
| 0 | 106 | 106 | 110 |
| 30 | | 111 | 119 |
| 60 | 111 | 117 | 131 |
| 90 | | 129 | 121 |
| 120 | 116 | 143 | 115 |
| 150 | | 161 | 114 |
| 180 | 168 | 179 | 120 |
| 210 | | 200 | 120 |
| 240 | 181 | 223 | 121 |
| 300 | 200 | | |
| 360 | 240 | | |

Samples A and B were 1.2 decitex Polyacrylonitrile fibers processed in 1.3% and 2% dispersions respectively, and Sample C was a 4.3 decitex fiber processed in a 2% dispersion.

TABLE 2

| | Residual Water Content | | |
|---|---|---|---|
| | Residual Water Content | | |
| Refining Time | Example A | Example B | Example C |
| 0 | 115 | 115 | 125 |
| 240 mins | | 508 | 533 |

Fibrillation Test II

Acrylic fiber (6 g, staple length 6 mm) from Example B and demineralised water (2 l) were placed in the bowl of the standard disintegrator described in TAPPI Standard T-205 om-88, and disintegrated (simulating valley beating) until the fiber was well-dispersed. Suitable disintegrators are available from Messmer Instruments Limited, Gravesend, Kent, UK and from Büchel van de Korput BV, Veemendaal, Netherlands. The Canadian Standard Freeness (CSF) of the fiber in the resulting slurry or stock was measured according to TAPPI Standard T227 om.97 and recorded in ml. The stock was divided into two 1 l portions for measurement of CSF and the two results averaged.

The results of CSF value versus refining time are given in Table 3 below.

TABLE 3

| Canadian Standard Freeness | |
|---|---|
| Refining time (min) | CSF (ml) |
| 0 | |
| 60 | 692 |
| 120 | 646 |
| 240 | 358 |

The results of the water imbibition and Canadian Standard Freeness test show a correlation between refining time and increased fibrillation. An increase in fiber content in the dispersion being processed also produces an increase in fibrillation over a given process time.

What is claimed is:

1. An oxidized fibrillated acrylic fiber made by a process including the steps of:

copolymerizing a mixture of olefinic monomers comprising acrylonitrile and an unsaturated carboxylic acid to form an acrylic polymer;

forming a solution of said acrylic polymer;

wet-spinning said solution to form gel-state acrylic fiber;

forming gel-state acrylic staple fiber from said gel-state acrylic fiber;

mechanically fibrillating said gel-state acrylic staple fiber to form gel-state fibrillated acrylic staple fiber;

drying said gel-state fibrillated acrylic staple fiber to form dried fibrillated acrylic staple fiber; and forming said oxidized fibrillated acrylic fiber by oxidizing said dried fibrillated acrylic staple fiber to an extent such that the oxidized fibrillated acrylic fiber contains about 8% by weight of added oxygen.

2. A fiber as claimed in claim 1 wherein said unsaturated carboxylic acid is selected from the croup consisting of itaconic acid and methacrylic acid.

3. A fiber as claimed in claim 2 wherein said acrylic polymer contains 0.5–2% of itaconic acid units.

4. A fiber as claimed in claim 1 wherein said gel-state acrylic fiber has a decitex value in the range 0.6–6.0 decitex.

5. A fiber as claimed in claim 1 wherein said gel-state acrylic fiber has a decitex value in the range 1.2–1.7 decitex.

6. A fiber as claimed in claim 1 wherein said gel-state acrylic staple fiber has a length of 4–12 mm.

7. A fiber as claimed in claim 1 wherein said gel-state fibrillated acrylic staple fiber has a Canadian Freeness value of less than 700.

8. A fiber as claimed in claim 1 said mixture of olefinic monomers further comprising as least one further monomer selected from the group consisting of methyl acrylate, methyl methacrylate and vinyl acetate.

9. A fiber as claimed in claim 6 wherein said gel-state acrylic staple fiber has a length of 6 to 8 mm.

10. A fiber as claimed in claim 7 wherein said gel-state fibrillated acrylic staple fiber has a Canadian Freeness value in the range of 350 to 450.

* * * * *